US005502925A

United States Patent [19]

Gorrell

[11] Patent Number: 5,502,925

[45] Date of Patent: Apr. 2, 1996

[54] WINDOW SASH ACTUATING MECHANISM

[75] Inventor: Robert A. Gorrell, Albuquerque, N.M.

[73] Assignee: A-Solution, Inc., Albuquerque, N.M.

[21] Appl. No.: 150,835

[22] Filed: Nov. 12, 1993

Related U.S. Application Data

[63] Continuation-in-part of Ser. No. 881,732, May 11, 1992, abandoned.

[51] Int. Cl.[6] ..... E05F 11/00

[52] U.S. Cl. ..... 49/361; 49/139; 49/449

[58] Field of Search ..... 49/360, 361, 139, 49/140, 352, 449; 474/101, 113, 117; 74/89.2, 89.21; 292/218, 202, 280

[56] References Cited

U.S. PATENT DOCUMENTS

| | | | |
|---|---|---|---|
| 369,023 | 8/1887 | Newell | 474/101 X |
| 860,518 | 7/1907 | Best | 49/361 X |
| 906,749 | 12/1908 | Strong | 49/361 X |
| 970,380 | 9/1910 | Monson | 49/361 X |
| 970,526 | 9/1910 | Mawdsley | 49/361 X |
| 1,132,683 | 3/1915 | Peterson | 49/361 X |
| 1,757,751 | 5/1930 | Strauss | 49/361 |
| 1,816,258 | 7/1931 | Lake | 49/362 X |
| 1,952,821 | 3/1934 | Quintilian | 49/361 X |
| 1,963,790 | 6/1934 | Jepsen | 49/361 X |
| 2,260,013 | 10/1941 | Elvers | 49/361 X |
| 2,600,441 | 6/1952 | Sommers et al. | 49/361 |
| 2,979,328 | 4/1961 | Henriksa | 49/361 |
| 3,261,113 | 7/1966 | March | 49/361 X |
| 3,948,114 | 4/1976 | Koinzan | 474/101 |
| 5,074,077 | 12/1991 | Toyoshima et al. | 474/117 X |
| 5,144,770 | 9/1992 | Kraus et al. | 49/360 |
| 5,301,734 | 4/1994 | Opel | 49/361 |

FOREIGN PATENT DOCUMENTS

| | | | |
|---|---|---|---|
| 835450 | 3/1952 | Germany | 49/361 |
| 609703 | 3/1960 | Italy | 74/89.2 |

*Primary Examiner*—Kenneth J. Dorner
*Assistant Examiner*—Jerry Redman
*Attorney, Agent, or Firm*—DeWitt M. Morgan; Kevin Lynn Wildenstein

[57] ABSTRACT

A mechanism for opening and closing the sash of a window which includes first and second sash brackets, a drive mechanism, first and second flexible timing belts, structure for connecting the timing belts to the sash brackets and mechanisms for connecting the two timing belts. The structure for connecting the timing belts is adjustable in length to facilitate the tensioning of the belts. Tensioning springs are also included.

31 Claims, 6 Drawing Sheets

WINDOW SASH ACTUATING MECHANISM

This application is a continuation-in-part of Ser. No. 07/881,732 filed May 11, 1992, now abandoned.

BACKGROUND OF THE INVENTION

This invention relates to window actuators for use in opening and closing single hung, double hung and horizontal sliding windows, with either a mechanical crank or power actuators which complies with: the requirements set forth in ANSI A117.1 as referenced by the Americans With Disabilities Act; and Chapter 12, 1204 of the 1991 Uniform Building Code ("Access and Exit Facilities and Emergency Escapes"). The invention can be used in both after market window conversions or can be incorporated into the design and manufacture of new window units.

DESCRIPTION OF THE PRIOR ART

Single hung, double hung and horizontal sliding windows are well known in the prior art. Actuating mechanisms for such windows, both mechanical and electrical, are also known.

A. A. Monson's Automatic Window Opener, U.S. Pat. No. 970,380, is designed exclusively for dual electric motor power activation that is dependant on an intact sash counterbalancing system. The opener includes a pair of electric motors D and $D^1$, a pair of endless chains E, each including a counter weight 11 and a helical spring 12. It is stated that the weights 11 counteract the weight of the lower sash "so that it can be raised and lowered with a small amount of power." Springs 12 "tend to take the strain off of the motors when the sash C closes against the lower end of the window frame before the current is cut off from the motors." Pull on both sides of the window sash is not synchronized. There are no provisions for manual hand crank operation. Finally, this device is not for retrofit application and is intended only for permanent installation as part of the original window assembly, to be incorporated in new construction.

U.S. Pat. No. 1,952,821 to B. F. Quintilian discloses a complicated crank mechanism, including a rotating drum and a centrifugal governor for opening and closing the lower sash of a double hung window. The system includes a "hoisting cable 5" which is securely attached at its opposite ends to the frame of the lower sash. Cable 5 is actuated by cable 16 which is, in turn, controlled by the crank mechanism.

The window operating mechanism of J. A. Jepsen, U.S. Pat. No. 1,963,790, is designed for operating the upper and lower sashes of a double hung window in both directions, independently of one another. The mechanism for opening and closing the upper sash includes a crank, a chain 8, a first steel ribbon 10 and a second steel ribbon 11. One end of the chain is connected to the lower end of the upper sash. Ribbon 10 is connected to the other end of chain 8 and to one of the upper corners of the upper sash. Ribbon 11 is connected at one end to ribbon 10; its other end passes over pulleys 13 and 16, and is connected to the other upper corner of the upper sash. The mechanism for the lower sash is essentially the same. J. A. Jepsen's window operator is only for incorporation into the manufacture of new window units and is not for a retrofit application to be attached to existing windows in a structure.

R. E. Elvers' Window Sash Operating Mechanism, U.S. Pat. No. 2,260,013, is similar to the above devices in that it is only intended to be integrated in the manufacture of window assemblies for installation in new construction; not as a retrofit on existing windows. This device includes a complicated pulley arrangement and depends upon counterbalancing weights for its mechanical advantage in raising and lowering the window sashes.

D. E. Hendrikson's Electrically Operated Window, U.S. Pat. No. 2,979,328, is, once again, only intended for newly manufactured window assemblies and can not be used as a retrofit to be added on to existing construction. The mechanism includes a pair of chains 8, both operated by reversible motor 15, and a single drive shaft 13. There is, however, no provision for adjustment or sash balancing.

U.S. Pat. No. 3,261,113 to S. M. March discloses a dual motor operated apparatus for moving a pair of chalk boards (10 and 11) up and down. Board 10 is provided with two chains C1 and C2 and one of the motors. C1 is attached to the upper left hand corner of board 10; C2, to the upper right hand corner. Similarly, board 11 is provided with two separate chains, C3 and C4, and the other motor. Chain C3 is attached to the upper left hand corner of board 11; C4, to the upper right hand corner. In all cases the chains (i.e., C1, C2, C3 and C4) are attached to their respective board corners by "an attaching bracket 12" with a "threaded connector 13 and nut 14". See column 2, line 18. In all cases, the opposite ends of the chains re connected to the frame, not the boards. Thus, C1 is secured to "wall 25" by a "pin 26". See column 2, lines 31–35. Chain C2 is attached to the same location. Similarly, chains C3 and C4 are attached to wall 25*a*, which is on the opposite side of frame 15. The pulleys 23 and 33 over which chains C1 and C2 pass are moved laterally by motor 42 and threaded shaft 36 to raise and lower board 10. Lowering is accomplished by gravitational forces. Neither board 10 nor 11 is pulled down by any chain or pulley system.

It is the basic object of the present invention to provide for a window actuator for single hung, double hung and horizontal sliding windows which: can be both easily retrofitted on existing windows as well as easily incorporated into the manufacture of new window units; can be actuated by either a mechanical crank or electrical power; and in which the power of actuation will be 5 pounds force (lbf) or less (with single handed operation, requiring no tight grasping, or pinching, or twisting of the wrist for operation, and with all controls within easy reach), so as to comply with the requirements of ANSI A117.1 as referenced by the Americans with Disabilities Act and, additionally, comply with national building codes and the requirements set forth in the Life Safety Code NFPA 101.

It is also an object of the present invention to provide a window opening and closing mechanism which is synchronized for simultaneous pull on both sides of the window sash, in both the opening and closing modes, for smooth tracking and to resist binding of the sash.

It is another object of the invention to incorporate unique drive and passive side sash attachments that automatically compensate for unequal sash balancing, and are not dependent on an intact sash balancing system.

It is another object to: manufacture the window operating mechanism of the present invention with, primarily, off the shelf parts, for simplicity of manufacturing and cost reduction; and use miniature synchronous timing belts, which are capable of 90 degree bend rotation to simplify power transmission to the movable sash on both the drive and passive sides.

It is yet another object of the invention to provide a unique belt tensioning mechanism to prevent belt slippage.

It is still another object of the present invention to provide an actuator which, both as a retrofit and when incorporated into new windows: allows the sash to be opened fully to permit emergency egress as required by the national building codes; allows simple manual "free wheeling" opening of the sash to which it is attached, quickly and without disconnecting the actuator from the sash; meets all applicable national building codes, American National Standards Institute, Inc. (ANSI) accessibility standards, Americans with Disabilities Act (ADA), and the National Fire Protection Association (NFPA) requirements; permits ease of operation by the disabled, elderly and children; and is capable of translating a typical 30 lb spring balanced closing force to less than 5 lbf. A "free wheeling" opening allows the operator to rapidly open the window to the maximum physical opening allowed by the window itself, without an appreciable amount of extra effort imparted by the window actuator modification. Thus, the device adds no restriction to the original range of movement of the sash and creates little additional drag on the standard and emergency operation of the window.

It is also an object of the present invention to provide a window actuator with a unique three position latching mechanism which: holds the sash in an infinite number of positions from fully opened to closed; can be operated one handed; can be operated very easily from the same side as the cranking mechanism to permit use by the disabled, elderly and children without movement from side to side of the window; and is not dependant on a fully intact window balancing mechanism for operation.

SUMMARY OF THE INVENTION

A mechanism for opening and closing the sash of a window which includes first and second sash brackets, a drive mechanism, first and second flexible timing belts, structure for connecting the timing belts to the sash brackets and mechanisms for interconnecting the two timing belts. Each timing belt has first and second ends. On the drive side the structure for interconnecting the first and second ends of the drive timing belt includes first and second belt attachment mechanisms coupled to each other by an adjustable linkage, the adjustable linkage passing through a projecting tab on the sash bracket. Each belt attachment mechanism includes a projecting tab and the adjustable linkage includes a compression spring captured between one of such projecting tabs and the projecting tab on the sash bracket. The linkage includes means for adjusting the distance between the projecting tabs on the belt attachment mechanisms. A similar belt interconnecting structure is provided on the idler side of the mechanism.

The opening and closing mechanism also includes springs attached to the timing belts to insure that they remain in tension during operation, and a latch mechanism. A method of tensioning the timing belts is disclosed.

DESCRIPTION OF THE PREFERRED EMBODIMENT

Figure 1:
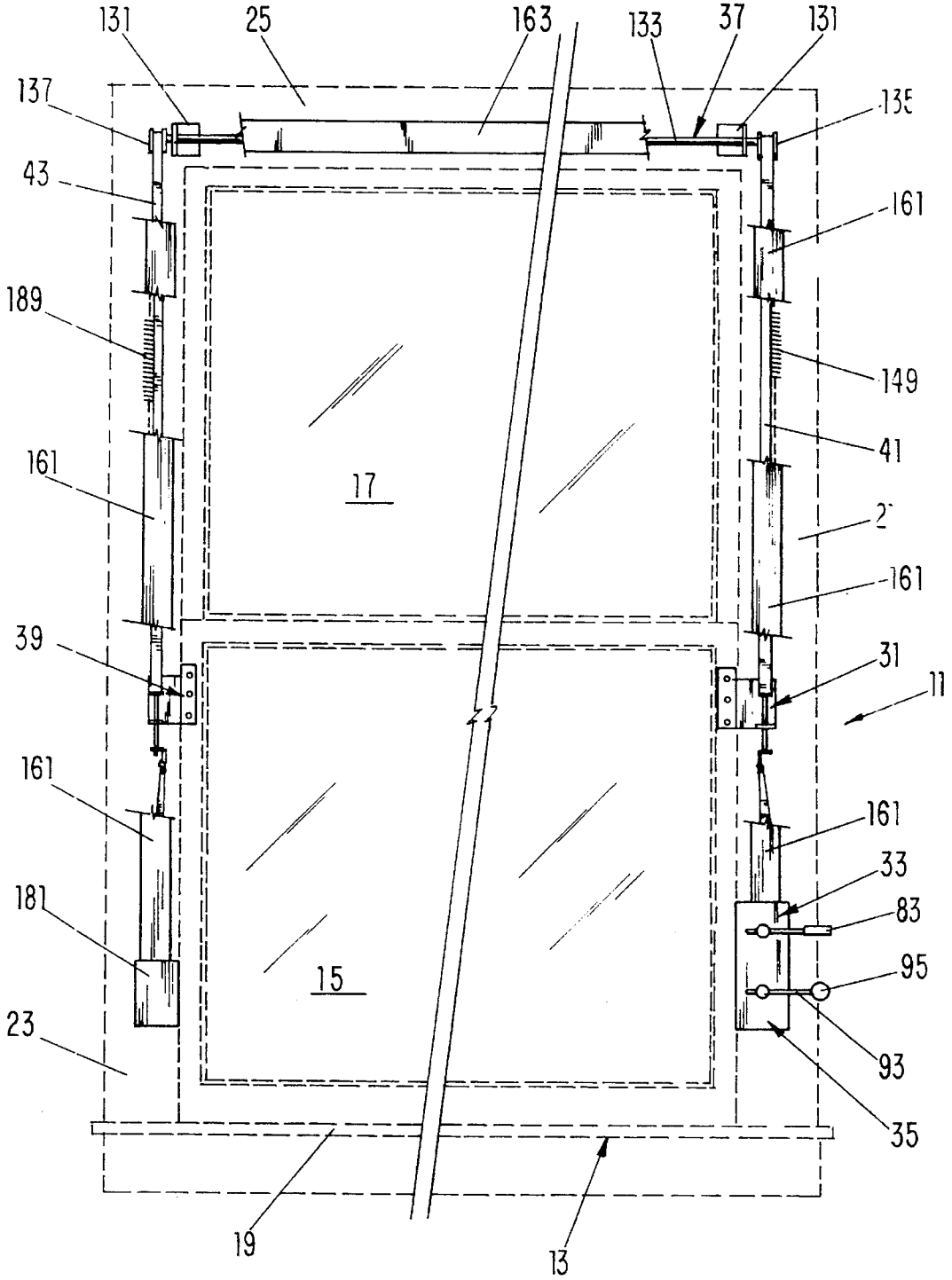
FIG. 1 is a front view of the preferred embodiment of the present invention, retrofitted to a previously installed window, with covers partially removed.

With reference to FIG. 1, retrofit window actuating mechanism 11 is shown installed on a conventional single hung or double hung window 13. Window 13 includes a lower sash 15, an upper sash 17, sill 19, jambs 21 and 23 and head 25.

Actuating mechanism 11 includes an attachment and balancing system 31, a latch mechanism 33, a power pulley assembly 35, a power transfer assembly 37, and an attachment and adjustment system 39. Attachment system 31, pulley assembly 35, and power transfer assembly 37 are all interconnected by a standard ⅕ pitch timing belt 41. In the preferred embodiment this belt is ⅜" wide. As explained in greater detail below, belt 41 is open ended, with its opposite ends connected to attachment and balancing system 31. Similarly, transfer assembly 37 and adjustment system 39 are interconnected by idler timing belt 43, the opposite open ends of which are connected to adjustment system 39.

Figure 2A:
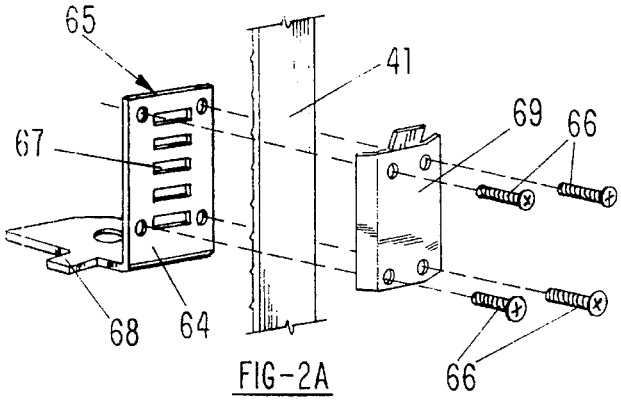
FIG. 2A is an enlarged exploded view of one of the belt attachment units which are parts of the mechanisms illustrated in FIGS. 2 and 3.
Figure 2B:
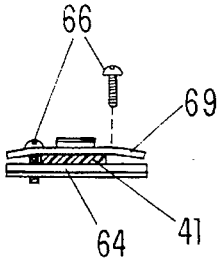
FIG. 2B is an enlarged sectional view of one of the attachment units, taken along line A—A of FIG. 2.
Figure 2:
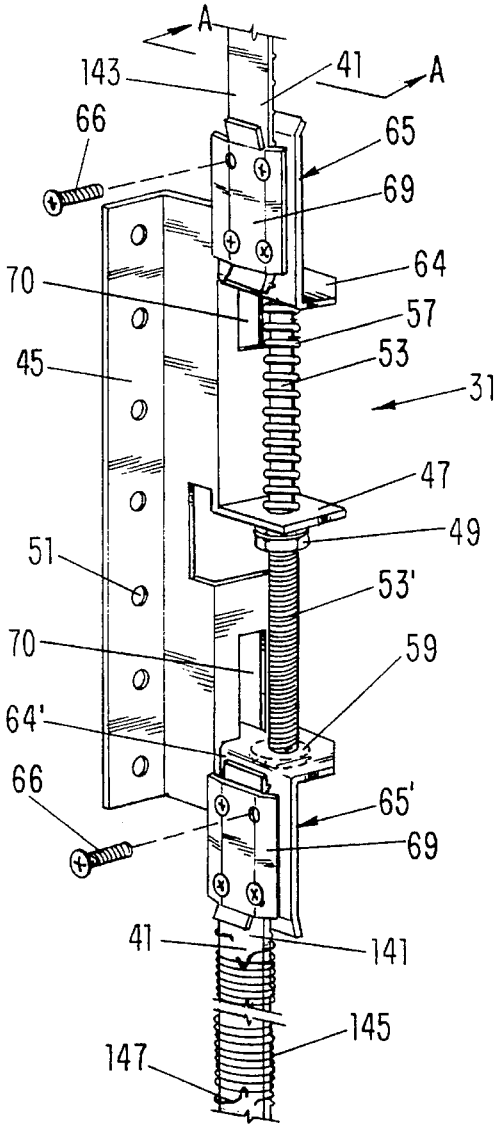
FIG. 2 is an enlarged view of the belt attachment and balancing mechanism on the power or drive side of the preferred embodiment.

With reference to FIG. 2, attachment and balancing system 31 includes sash attachment bracket 45 having, in horizontal cross-section, a generally Z-shaped configuration and a projecting tab or bracket 47 having a circular opening therein. Bracket 45 is attached to sash 15 via, for instance, screws (not shown which are seated in through holes such as illustrated at 51. System 31 also includes: attachment unit 65; a balancing shaft 53, having a slotted head (not shown) on its upper end and threaded at least on the lower portion thereof (as illustrated by 53'; a compression spring 57 captured between the lower, horizontal leg of L-shaped bracket 64 (of belt attachment unit 65, FIG. 2A) and tab 47 of bracket 45; and belt attachment unit 65'. Attachment units 65, 65' are interconnected by shaft 53, as illustrated, with the slotted head seated against the horizontal leg of bracket 64 and with bracket 64' being retained by adjustment nut 59 (shown in broken lines). Spring 57 is pre-loaded in compression by double jam nuts 49 counter tightened against each other. Each belt attachment unit 65 and 65' include slots 67, for receiving teeth of timing belt 41, and a compression plate 69 and screws 66 to securely capture belt 41 without pinching or crimping. Double jamb nuts 49 prevent movement of balancing shaft 53 in, as viewed in FIG. 2, an upward direction relative to bracket 47. However, as explained below, shaft 53 is free to move downward relative to bracket 47 against the bias of spring 57. Tongue 68 of belt attachment unit 65 mates into elongated slot 70 of bracket 45 reducing any potential for shaft 53 to rotate or twist relative to bracket 45.

Figure 5:
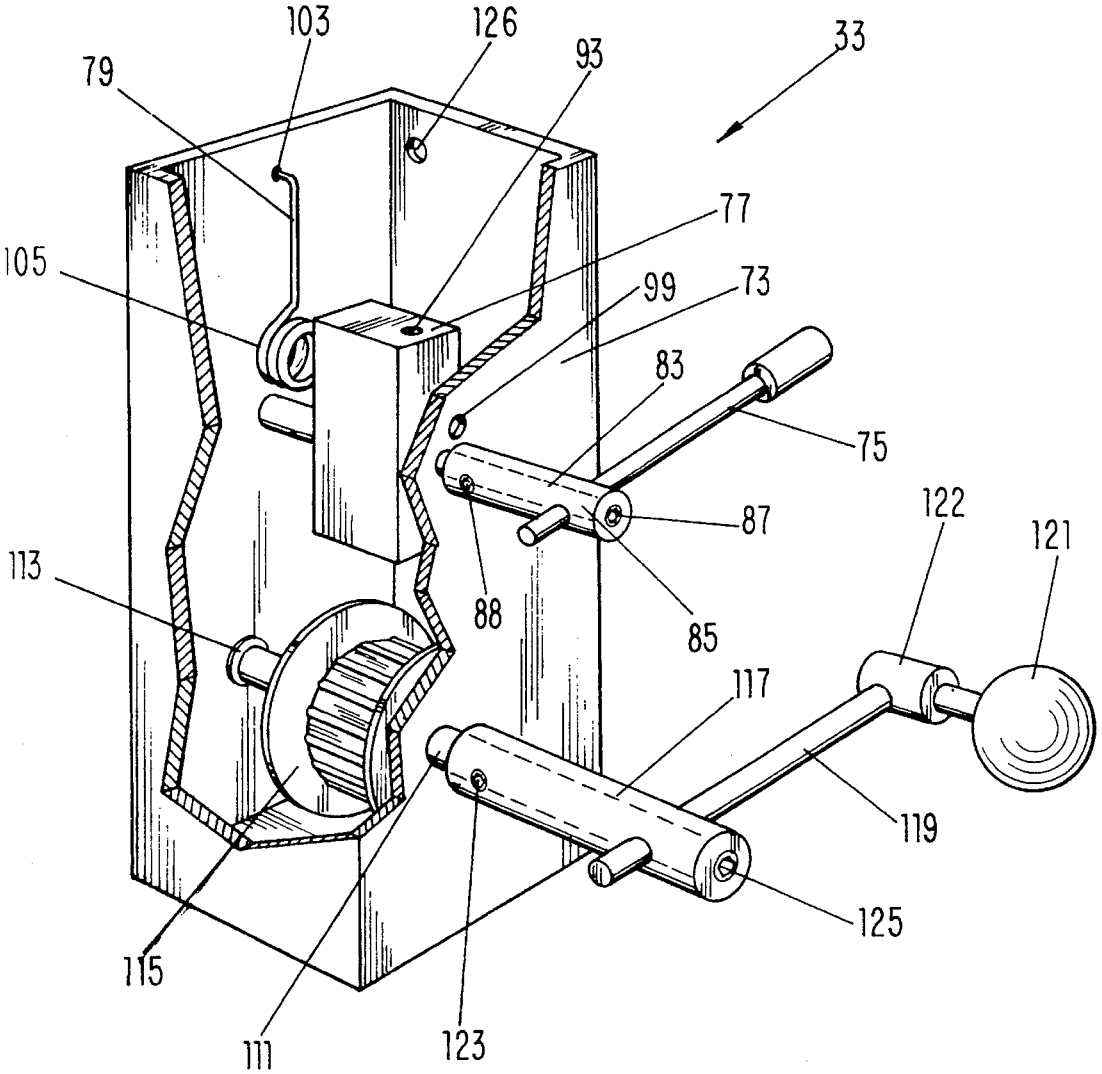
FIG. 5 is an enlarged, partially broken away, perspective view of the latch and crank mechanisms of FIG. 1.
Figure 6:
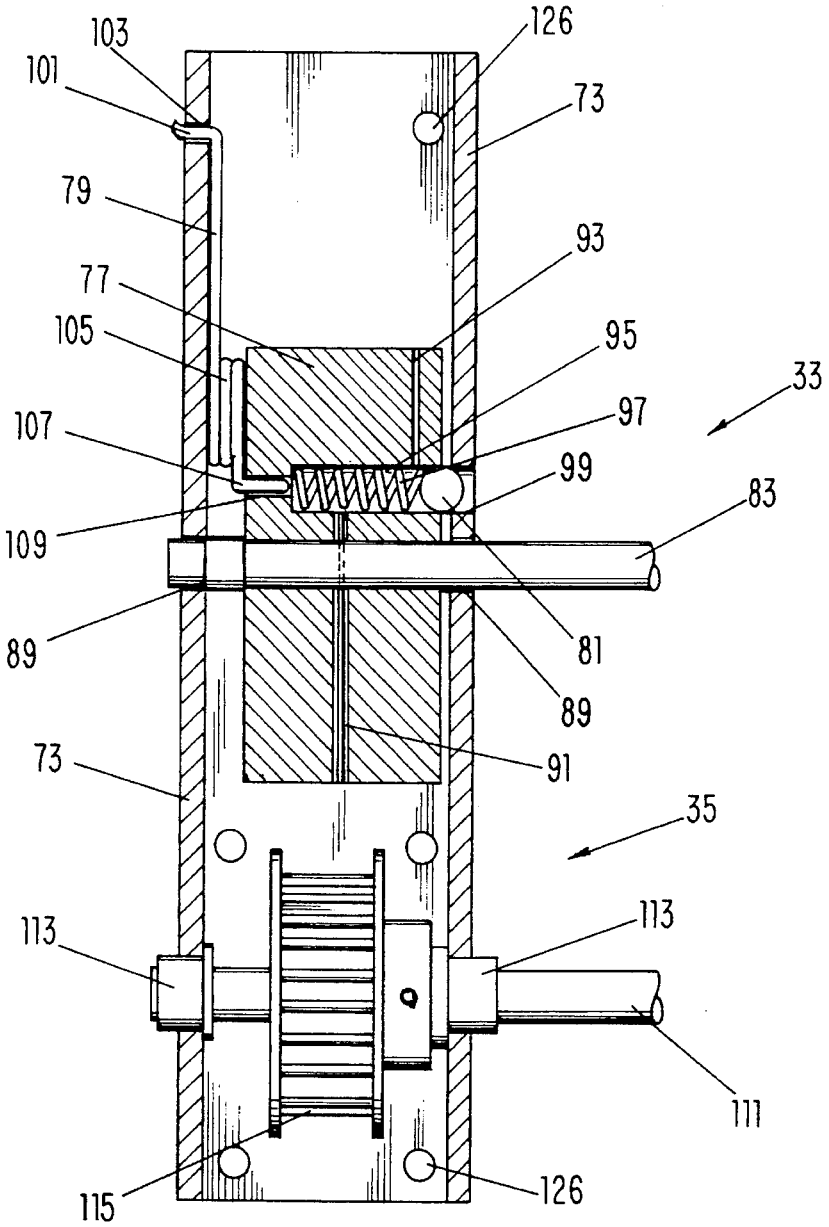
FIG. 6 is a sectional view of the latch and crank mechanisms of FIG. 5.

Latch mechanism 33, FIGS. 5 and 6, includes a housing 73 in the form of a rectangular open ended tube, a latching lever 75, an engaging wedge 77, a biasing spring 79 and a centering ball latch 81. Lever 75 is connected to wedge 77 via shaft 83 and sleeve 85, which is counterbored to receive both lever 75 and shaft 83. The relative positions between lever 75, shaft 83 and sleeve 85 are adjustable and, also, lockable via set screws 87 and 88. Shaft 83 is supported by bored holes 89 in housing 73 and fixed to wedge 77 via roll pin 91 received in bore in wedge 77. Ball latch 81 is received in bore 95 in wedge 77, as is spring 97, which biases ball 81 into detent opening 99 in housing 73, to hold wedge 77 in its neutral position. Biasing spring 79 includes a projecting tab 101 (which is captured in bore 103 of housing 73) a coiled portion 105 and a second tab 107 (which is received in a bore 109 in wedge 77). Wedge 77 also includes an oil hole 93.

Figure 7A:
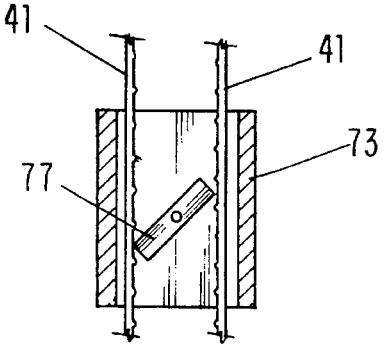
FIG. 7A is a schematic showing the wedge of the latching mechanism of FIGS. 5 and 6 in the position where the sash cannot be further opened.
Figure 7B:
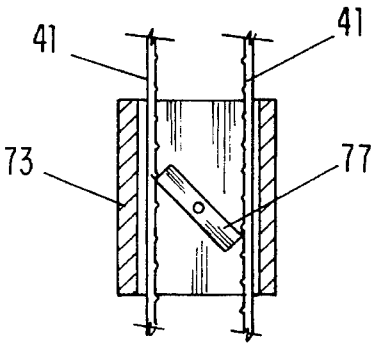
FIG. 7B is a schematic showing the wedge of the latching mechanism of FIGS. 5 and 6 in the position where the sash cannot be closed.

When wedge 77 is in the neutral position, as illustrated in FIGS. 5 and 6, spring 79 is compression loaded and would like to extend, thereby pushing wedge 77 into either the position illustrated in FIG. 7A or FIG. 7B. Wedge 77 is maintained in the neutral position so long as ball 81 is received in detent 99. However, when lever 75 is rotated either clockwise or counterclockwise, ball 81 is forced out of detent 99, thereby allowing spring 79 to bias wedge 77 into engagement with belt 41.

Again, with reference to FIGS. 5 and 6, power pulley assembly 35 is also positioned in housing 73, beneath and adjacent to latch mechanism 33. Assembly 35 includes: a pulley shaft 111, journaled by bearings 113 positioned in the front and back sides of housing 73; a conventional timing belt drive pulley 115 keyed or otherwise secured to shaft 111; an adjustable length crank shaft 117; an adjustable length crank arm 119; and a crank handle 121 which rotates relative to housing 122. Crank shaft 117 is counterbored to adjustably receive shaft 111, after which set screw 123 is tightened. Crank shaft 117 also has a through bore, which slidably receives arm 119, and a second set screw 125 that is used to hold arm 119 in the desired position. Finally, housing 73 includes mounting holes 126. As those skilled in the art will appreciate, other crank mechanisms, as well as fixed and portable electrical power (such as a standard cordless screwdriver) can be used to rotate shaft 111 and pulley 115.

Power transfer assembly 37, FIG. 1, includes a pair of L-shaped brackets 131, secured (by screws or other suitable fasteners, not shown) to opposite sides of window head 25. Brackets 131 are provided with oppositely facing bores which support the opposite ends of power transfer shaft 133. Fastened to the opposite ends of shaft 133 are a pair of power transfer pulleys 135 and 137. Pulleys 135 and 137 are, like drive pulley 115, standard timing belt pulleys.

As is also evident from FIGS. 1 and 2, belt 41 is secured at its lower end 141 to attachment unit 65', passes through housing 73, around drive pulley 115, then over power transfer pulley 135 and then connected at its opposite end 143 to the upper end of attachment and balancing system 31, via attachment unit 65. Adjacent end 141 of belt 41 is opening tension spring 145, including spring attachment clips 147. As is evident from FIG. 1 and FIGS. 4A and 4B, located on belt 41, between drive pulley 115 and power transfer pulley 135, is closing tensioning spring 149, including a pair of spring attached clips 151. The function of springs 145 and 149, and clips 151, is explained below.

Figure 3:
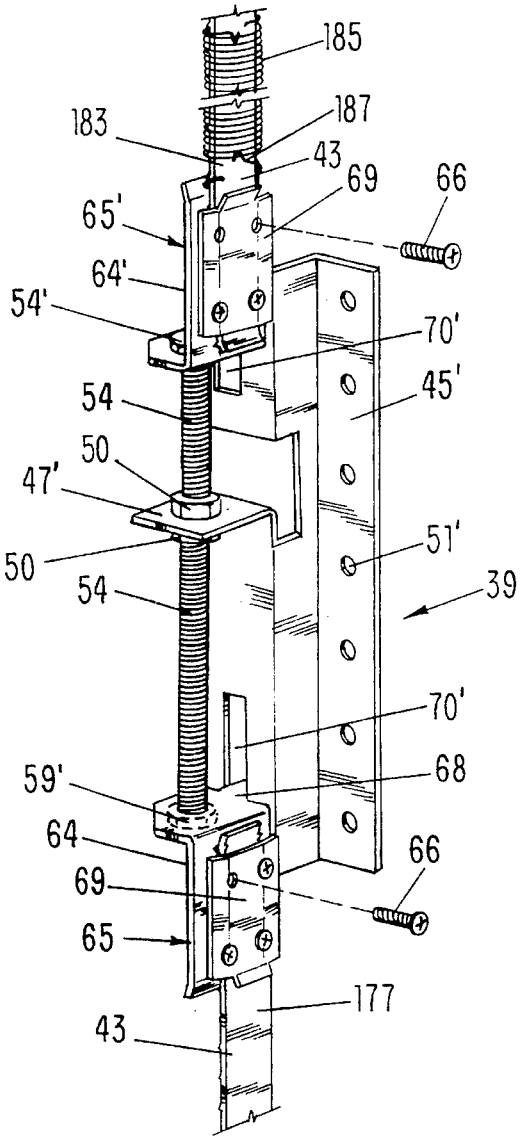
FIG. 3 is an enlarged view of the belt attachment and adjustment mechanism used on the idler side of the preferred embodiment.

With reference to FIG. 3, attachment and adjustment system 39 includes an attachment bracket 45', which in horizontal cross-section has a generally Z-shaped configuration, and an L-shaped tab or bracket 47'. Bracket 45' is also secured to sash 15, via additional screws (not shown) and through holes 51', on the side portion of sash 15 directly opposite to bracket 45. System 39 also includes: an L-shaped bracket 64'; a threaded shaft 54 which passes through the openings (not shown) in brackets 64', 47', and 64 with the slotted head 54' of shaft 54 seated against the lower horizontal leg of bracket 64'; a first pair of adjustment nuts 50, threaded on shaft 54 on opposite sides of bracket 47'; and a second adjustment nut 59' (shown in broken lines) which captures the upper horizontal leg of L-shaped bracket 64.

Belt 43 is secured at its lower end 177 to a third attachment unit 65, as illustrated in FIG. 3. As illustrated in FIG. 1, belt 43 then passes around idler timing belt pulley (not shown), positioned within housing 181 which is secured (by fasteners, not shown) to jamb 23, passes over power transfer pulley 137 and then back down to attachment and adjustment system 39. End 183 is connected to a fourth attachment unit 65', as also illustrated in FIG. 3. As with belt 41, belt 43 includes a closing spring tensioner 185, secured via attachment clips 187, and an opening tensioning spring 189, secured via the same type of clips used for spring 149 (see FIGS. 4A and 4B).

Figure 4C:
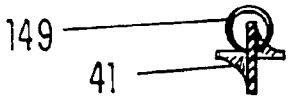
FIG. 4C is a sectional view of belt and tension spring taken through FIG. 4A along line C—C.
Figure 4D:
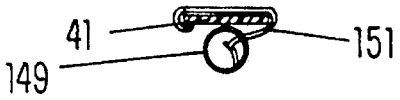
FIG. 4D is a sectional view of belt and tension spring taken through FIG. 4B along line D—D.
Figure 4A:
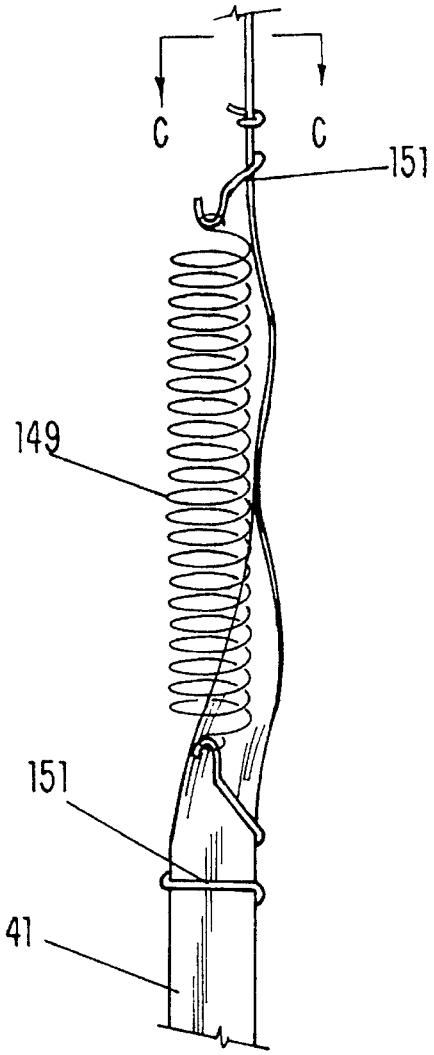
FIG. 4A is an enlarged view of the belt closing tensioning spring on the drive side, with the spring in its contracted position.
Figure 4B:
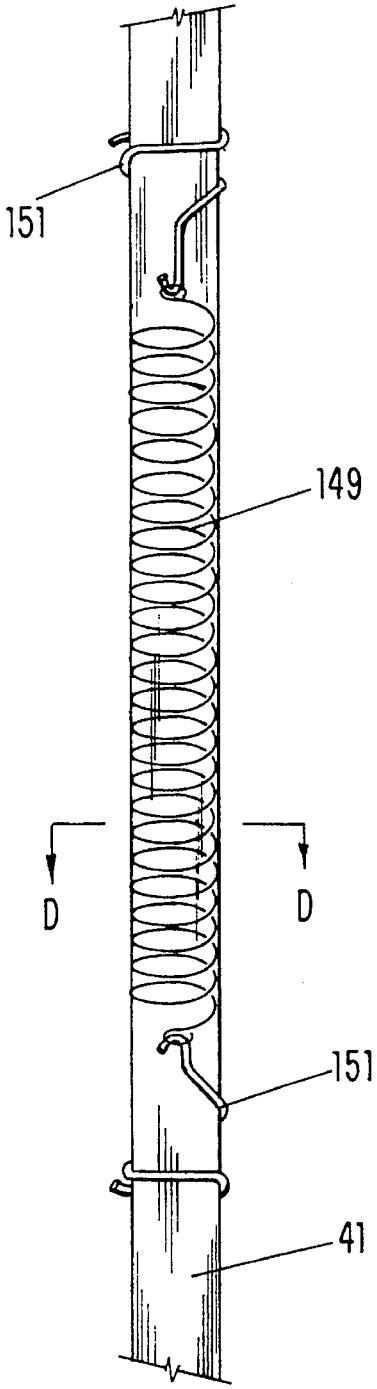
FIG. 4B is an enlarged view of the belt tensioning spring of FIG. 4A, with the spring in its extended or idle position.

Installation and adjustment of system 11 is quick and easy. First systems 31 and 39 are attached to the opposite sides of lower sash 15 as illustrated in FIG. 1. Assemblies 33, 35, 37 and housing 181 with its idler pulley are attached to jams 21 and 23. Belts 41 and 43 are then attached to, respectively, systems 31 and 39. Next the majority of slack is manually removed from belt 41 and the plates 69 of attachment units 65 and 65' (see FIG. 2) tightened to securely attach the belts thereto. Tension springs 145, 149, 185 and 189 are then attached, at the locations indicated in FIGS. 1, 2 and 3, via clips (e.g. 147, 151, and 187). The tension on spring 149 at initial installation is as illustrated in FIG. 4B. The distance between clips 151 and the spring rate of spring 149 is chosen to provide the correct belt tensioning. Further, as illustrated in FIGS. 4A and 4B, each of clips 151 has opposing 35° bends from perpendicular, between which belt 41 passes, which assists belt 41 to fold inwards towards spring 149 (when taking up belt tension during normal operation), as illustrated in FIG. 4A. This causes the belt slack to double loop which takes up less space horizontally. The installation of spring 145 is the same. Finally, nut 59 is adjusted, relative to shaft 53, to pull belt 41 taut and to stretch both spring 149 (to the position illustrated in FIG. 4B) and spring 145. Belt 41 is correctly tightened when all slack is removed from between belt attachment clips 147, 147 and 151, 151.

A similar procedure is followed for correctly tensioning belt 43. First, the majority of the slack is manually removed and plates 69 of attachment units 65 and 65' tightened. Secondly, tension springs 185, 189 are attached in the locations indicated in FIGS. 1 and 3. Adjustment nut 59' is then adjusted relative to threaded shaft 54 to pull belt 43 taut. Finally, adjustment nuts 50 are also adjusted relative to threaded shaft 54, either up or down, to insure that sash 15 is both parallel and square with the rest of window 13. Adjustment nuts 50 are then counter tightened against each other to lock them in position. Further adjustment or repositioning should not be required.

Once installed, attachment and balancing system 31, timing belt 41, timing belt 43, and attachment and adjustment system 39 may, for cosmetic purposes be covered with an L-shaped channel, such as illustrated at 161 in FIG. 1. Similarly, power transfer assembly 37 is covered by a U-shaped channel 163 in FIG. 1.

In operation, with the drive system located on the right hand side of window 13, crank shaft 111 is rotated in a clockwise direction to open sash 15; counterclockwise to close. If the drive system is located on the left hand side of window 13, which can be achieved by simply reversing the position of the drive and idler sides, the motion of crank shaft 111 will be just the opposite. Belt 41 passes over power pulley 135, rotating shaft 133 and power pulley 137 in unison. This, in turn, moves belt 43 substantially in unison with belt 41 so that the opening and closing forces are applied substantially equally on both sides of sash 15. During this movement of belts 41 and 43, the tensioning springs 145, 149, 185 and 189 function to take up belt slack on the slack side of the belts. Thus, for instance, during opening spring 149 remains in the position illustrated in FIG. 4B, while spring 145 takes up the slack between pulley 115 and attachment and balancing system 31. When window 13 is being closed spring 149 has the configuration illustrated in FIG. 4A, while spring 145 has the same configuration as illustrated for spring 149 in FIG. 4B. Springs 185 and 189 function in just the opposite manner.

In the event the drive side of sash 15 seats against sill 19 before the idler side when sash 13 is being closed, the balancing portion of attachment and balancing system 31 operates as follows: with continued rotation of crank shaft 111, lower end 141 of belt 41 will continue to move downward pulling balancing shaft 53, and the upper end 143 of belt 41 with it, compressing spring 57. Attachment bracket 45 remains stationary. However, because belt 41 continues to move, power continues to be transferred to belt 43, via pulleys 135 and 137 and shaft 133. This motion of belt 43 pulls the idler side of sash 15 into seating position with sill 19. The balancing spring 57 is sized to the system so that the force required for complete compression is greater than that required for proper seating, but less than the minimum force required to do damage to the system 11 or the window 13. In the preferred embodiment, balancing shaft 53 has a maximum travel of, approximately ¾ inches. The maximum force required at the crank handle to accomplish this maximum ¾" travel is less than 5 lbf, with crank handle 121 positioned approximately 6 inches from crank shaft 111.

If the idler side of sash 15 closes ahead of the driver side, the designed "give" (i.e., the stretch in belts 41 and 43 and the spring twist of shaft 133) in the components of system 11, between attachment and adjustment system 39 and power pulley 115 permit an additional, approximately ¾", closing travel on the driver side.

With the inclusion of latching mechanism 33, sash 15 may be latched from either opening or closing in any position. This provides a feature missing from almost all windows, the ability to crack window 13 for ventilation and securely hold sash 15 in the desired position. This also provides a hold open mechanism for windows in which the counter balance systems have failed or are missing. With reference to FIGS. 5, 6, 7A and 7B, latching is achieved when lever 75 is pushed either up or down from its center (neutral) position, with enough force (less than 5 lbf) to push ball 81 out of detent 99 and simultaneously rotate wedge 77. Preloaded torsional spring 79 then pushes wedge 77 into engagement with belt 41. In the case of the position illustrated in FIG. 7A, sash 15 can be closed, either via crank mechanism 39 or by manually pushing down on sash 15, but not opened. In the case of the position illustrated in FIG. 7B, sash 15 cannot be closed, but can be opened, again either via crank mechanism 39 or manually. Once wedge 77 is set, force used in attempt to move the window against its latched position only further wedges or locks the belt 41 against the side walls of housing 73. This design complies with Chapter 12, §1204 of the Uniform Building Code.

Figure 8:
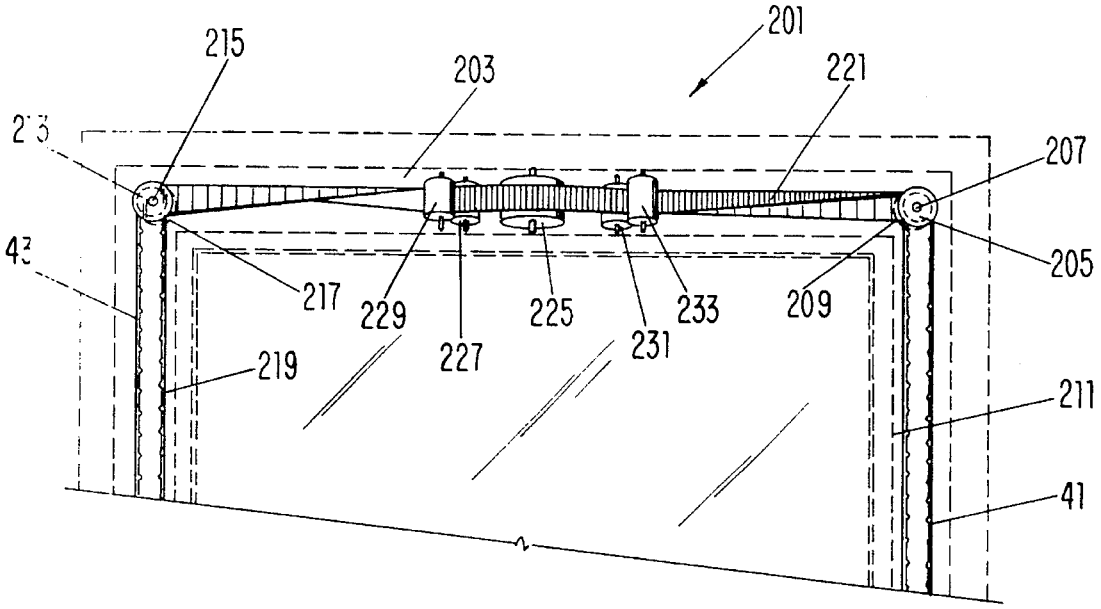
FIG. 8 is a partial front view of the present invention with an alternate power transfer mechanism shown partially in perspective.
Figure 9:
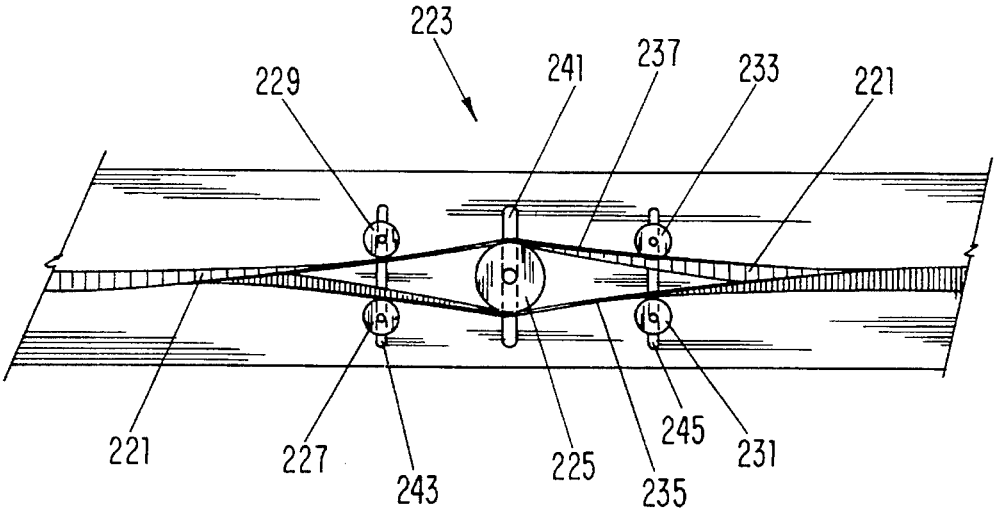
FIG. 9 is a bottom view of the separation and tensioning mechanism used in the embodiment of FIG. 8.

With reference to FIGS. 8 and 9, system 201 with alternate power transfer mechanism 203 is illustrated. In system 201, drive belt 41 passes over pulley 205 (instead of 135 as in the previous embodiment). Pulley 205 is secured to a stub shaft 207, along with pulley 209, which shaft is rotatably secured in the internal channel of jamb 211. Similarly, idler belt 43 passes over pulley 213 which is secured to shaft 215, along with pulley 217 for simultaneous rotation therewith. Shaft 215 is similarly rotatably secured in the internal channel of jamb 219.

Pulley 209 is connected to pulley 217 via continuous belt 221. Power transfer mechanism 203 includes a belt tensioning mechanism 223 which includes central roller 225 and tensioning roller pairs 227, 229 and 231, 233. Roller pairs 227 and 229 are biased toward each other by springs (not shown), as are rollers 231, 233, which provide the force necessary for static tensioning of belt 221. Rollers 227, 229, 231 and 233, along with large roller 225 also twist belt 221, as illustrated, so that opposing sides thereof do not rub.

In operation, correct belt tensioning must be present at both sides of pulleys 209 and 217 to prevent belt slippage and, therefore, the system going out of sync. With the present design, when power is transferred via section 235 of belt 221, slack (due to belt stretch) develops in section 237. This causes large roller 225 to be pushed into belt section 237 to take up this slack. Roller 225 is mounted in a track 241 which allows it to move freely in directions perpendicular to, but not parallel with, belt 221. Similarly, rollers 227, 229, 231 and 233 are mounted in parallel tracks 243 and 245.

Whereas the drawings and accompanying description have shown and described the preferred embodiment of the present invention, it should be apparent to those skilled in the art that various changes may be made in the form of the invention without affecting the scope thereof.

I claim:

1. A mechanism for opening and closing the sash of a window, said mechanism including:

a. a first sash attachment means for attachment to said window sash;

b. a drive mechanism;

c. an elongated flexible power transfer means connected to said drive mechanism, said flexible power transfer means having first and second ends; and d. means for interconnecting said first and second ends to each other and to said first sash attachment means, said interconnecting means including a first attachment unit connected to said first end, a second attachment unit connected to said second end, and adjustable connecting means for connecting said first and second attachment units, said adjustable means for connecting being connected to said first sash attachment means by means which permit relative movement between said adjustable means for connecting and said first sash attachment means, said adjustable means for connecting including means for adjusting distance between said first and second ends.

2. The mechanism as set forth in claim 1, wherein said first sash attachment means includes a first projecting tab, said first attachment unit includes a second projecting tab, and said adjustable means for connecting includes a spring captured between said projecting tabs.

3. The mechanism as set forth in claim 2, wherein said second attachment unit includes a third projecting tab, and wherein said adjustable means for connecting includes means for adjusting the position of said third tab relative to said first tab.

4. The mechanism as set forth in claim 2, wherein said adjustaable means for connecting is a shaft having a first end and a second threaded end, said first projecting tab having a through opening therein, said second projecting tab having a through opening therein, said shaft passing through both said through openings, said spring being a compression spring and surrounding said shaft between said first tab and said second tab, whereby when said sash is closed, said flexible power transfer means can move relative to said sash attachment means.

5. The mechanism as set forth in claim 1, further including a first tensioning means and means for attaching said first tensioning means to an intermediate section of said flexible power transfer means, whereby said first tensioning means is in tension to take up any slack in said flexible power transfer means during both installation of said flexible power transfer mechanism and use in opening and closing said sash, to prevent slippage between said flexible power transfer mechanism and said drive mechanism.

6. The mechanism as set forth in claim 5, wherein said first means for attaching said tensioning means includes a pair of clips which assist said flexible power transfer mechanism to fold inward towards said first tensioning means.

7. The mechanism as set forth in claim 6, further including a second tensioning means and second means for attaching said second tensioning means to said flexible power transfer means, said first tensioning means being positioned between said drive mechanism and said first attachment unit, said second tensioning means being positioned on said flexible power transfer means between said drive mechanism and said second belt attachment unit.

8. The mechanism as set forth in claim 1, wherein said first attachment unit includes means for taking up slack in said flexible power transfer means.

9. The mechanism as set forth in claim 8, wherein said second attachment unit includes means for taking up slack in said flexible power transfer means.

10. The mechanism as set forth in claim 8, wherein said flexible power transfer means is a timing belt having evenly spaced teeth thereon and wherein said first attachment unit includes an L-shaped member having first and second legs, one of said legs having a plurality of evenly spaced slots therein, said spacing of said slots matching said spacing of said teeth, and means for holding said teeth in said slots.

11. The mechanism as set forth in claim 1, further including a latch mechanism for holding said sash in an infinite number of open positions.

12. The mechanism as set forth in claim 11, wherein said flexible power transfer means has opposing parallel sections, and wherein said latch mechanism includes a wedging member, means for rotatably supporting said wedging member between said parallel sections of said flexible power transfer means, means for holding said wedging member in a neutral position between said parallel sections of said flexible power transfer means, and means for bidirectionally biasing said wedging member into engagement with said flexible power transfer means.

13. The mechanism as set forth in claim 12, wherein said means for holding includes a ball detent, said means for rotatably supporting includes a lever, and said biasing means is a spring which moves said wedging member in the direction of rotation of said lever.

14. The mechanism as set forth in claim 12, wherein said wedging member simultaneously engages said parallel sections of said flexible power transfer means, whereby said flexible power transfer means can move in one direction relative to said wedging means but attempted motion of said flexible power transfer means in the opposite direction further forces said wedging member into engagement with said parallel sections.

15. The mechanism as set forth in claim 1, further including a second sash attachment means, a second flexible power transfer means, and means for transferring power from said flexible power transfer means to said second flexible power transfer means, said second flexible power transfer means interconnecting said second sash attachment means to said power transfer means.

16. The mechanism as set forth in claim 15, wherein said second flexible power transfer means has first and second ends, and further including second means for interconnecting said first and second ends of said second flexible power transfer means with each other and said second sash attachment means.

17. The mechanism as set forth in claim 16, wherein said second interconnecting means includes third and fourth attachment units and means for adjusting the position between said third and fourth attachment units.

18. The mechanism as set forth in claim 17, wherein said second sash attachment means includes a fourth tab with a through opening therein, wherein said third attachment unit includes a fifth tab with a through opening therein, wherein said fourth attachment unit includes a sixth tab with a through opening therein, and wherein said means for adjusting the position between said third and fourth attachment units is a threaded shaft which passes through said openings in said fourth, fifth and sixth tabs and includes means for adjusting the position of said fourth tab relative to said threaded shaft, to adjust the position of said second sash attachment means relative to said second flexible power transfer means.

19. The mechanism as set forth in claim 18, wherein said threaded shaft includes means for adjusting the position between said fifth and sixth tabs.

20. The mechanism as set forth in claim 18, further including a third tensioning means and means for attaching said third tensioning means to an intermediate section of said second flexible power transfer means, whereby said third tensioning means is in tension to take up any slack in said second flexible power transfer means, during both installation of said flexible power transfer mechanism and use in opening and closing said sash.

21. The mechanism as set forth in claim 20, wherein said means for attaching said third tensioning means includes a pair of clips which cause said second flexible power transfer mechanism to fold inwards towards said third tensioning means.

22. The mechanism as set forth in claim 15, wherein said means for transferring power from said flexible power transfer means to said second flexible power transfer means includes first and second timing belt pulleys and means for interconnecting said pulleys, both said flexible power transfer means being timing belts for synchronous movement with each other.

23. The mechanism as set forth in claim 22, wherein said first sash attachment means includes a first projecting tab, said first attachment unit includes a second projecting tab, and said adjustable means for connecting includes a spring captured between said first and second projecting tabs.

24. The mechanism as set forth in claim 23, wherein said second attachment unit includes a third projecting tab, and wherein said adjustable means for connecting includes means for adjusting the position of said third tab relative to said first tab.

25. The mechanism as set forth in claim 24, wherein said second flexible power transfer means has first and second ends, and further including second means for interconnecting said first and second ends of said second flexible power transfer means with each other and said second sash attachment means.

26. The mechanism as set forth in claim 25, wherein said second interconnecting means includes third and fourth attachment units and means for adjusting the position between said third and fourth attachment units.

27. The mechanism as set forth in claim 22, wherein said means for interconnecting said pulleys is flexible to permit limited rotation of said first timing belt pulley relative to said second timing belt pulley.

28. The mechanism as set forth in claim 27, wherein said means for interconnecting said pulleys includes a continuous flexible timing belt and means for automatically taking up slack in said belt to prevent slippage.

29. The mechanism as set forth in claim 28, wherein said means for taking up slack includes a central roller, a first pair of rollers, means for biasing said first pair of rollers towards each other, a second pair of rollers, and means for biasing said second pair of rollers towards each other, said center roller being positioned between said pairs of rollers.

30. In a drive mechanism including a drive member having first and second portions which are parallel to each other and which move in opposite directions, a latch mechanism, said latch mechanism including a wedging member, means for rotatably supporting said wedging member between opposing parallel portions of said drive member, means for holding said wedging member in a neutral position between said parallel portions of said drive member, and means for bidirectionally biasing said wedging member into engagement with said drive member.

31. A window with an opening and closing mechanism, said window comprising:

a. a frame including a movable window sash;

b. a first sash attachment means attached to said sash;

c. a drive mechanism secured to said frame;

d. an elongated flexible power transfer means connected to said drive mechanism, said flexible power transfer means having first and second ends; and e. means for interconnecting said first and second ends to each other and to said first sash attachment means, said interconnecting means including a first attachment unit connected to said first end, a second attachment unit connected to said second end, and adjustable connecting means for connecting said first and second attachment units, said adjustable means for connecting being connected to said first sash attachment means by means which permit relative movement between said adjustable means for connecting and said first sash attachment memos, said adjustable means for connecting including means for adjusting distance between said first and second ends.

* * * * *